US005375921A

United States Patent [19]

Tupa et al.

[11] Patent Number: 5,375,921

[45] Date of Patent: Dec. 27, 1994

[54] CONTROL PANEL BRACKETS

[75] Inventors: Timothy J. Tupa; Robert McFarland; James L. Ayres, all of Springfield, Tenn.

[73] Assignee: White Consolidated Industries, Inc., Cleveland, Ohio

[21] Appl. No.: 32,130

[22] Filed: Mar. 17, 1993

[51] Int. Cl.[5] ..... A47B 47/00

[52] U.S. Cl. ..... 312/257.1; 312/279

[58] Field of Search ..... 312/223.1, 236, 257.1, 312/265.5, 265.6, 279; 220/4.02

[56] References Cited

U.S. PATENT DOCUMENTS

| | | | |
|---|---|---|---|
| 3,253,874 | 5/1966 | Czech | 312/223.1 X |
| 4,003,613 | 1/1977 | Oakley | 52/595 X |
| 4,288,133 | 9/1981 | Deatherage | 312/265.6 X |
| 4,522,310 | 6/1985 | Mikic et al. | 220/4.02 X |
| 4,798,424 | 1/1989 | Coates et al. . | |

*Primary Examiner*—Brian K. Green

*Attorney, Agent, or Firm*—Pearne, Gordon, McCoy & Granger

[57] ABSTRACT

A control panel assembly for a domestic appliance providing an improved assembly which insures uniform and proper alignment of control instruments mounted therein. The control panel assembly includes a control panel faceplate, a control instrument mounting bracket, and a bracket retainer. The faceplate includes an indexing or positioning notch into which the mounting bracket, which has the control instruments mounted thereto, fits to correctly locate the control instruments relative to openings in the faceplate. The bracket retainer attaches the mounting bracket to the control panel faceplate. The control panel faceplate, with the mounting bracket and bracket retainer mounted thereon, is slidably and removably attached to a trim wrapper and deflector provided by the control panel. The present invention improves upon control panels known in the art which do not index or relate the control instruments or mounting bracket to the faceplate, and which do not allow access to the control instruments from a front of the control panel.

20 Claims, 6 Drawing Sheets

CONTROL PANEL BRACKETS

BACKGROUND OF THE INVENTION

1. Field of the Invention

The present invention relates generally to domestic appliances and, more particularly, to an improved control panel assembly for use in such appliances.

2. Description of the Related Art

Domestic appliances typically include a control panel which extends upwardly from a rear or back upper surface of an appliance cabinet. The control panel includes a faceplate which provides apertures through which extend shafts or stems of various rotary or pushbutton control instruments. These shafts or stems usually have snap fit thereon a control knob or pushbutton cap which is engaged by the user to actuate or adjust the control instrument and thereby control the operation of the appliance.

It is important from an aesthetic point of view that the control instruments consistently align with the faceplate apertures so that the resulting appliances have an attractive and uniform appearance. However, during development of control panels, alignment of the control instruments with the faceplate apertures has been problematic.

In one known prior art domestic appliance, an instrument mounting plate is provided beneath the control panel faceplate and serves as a base or support for control instruments which are mounted thereto. The mounting plate extends the entire width of the control panel and is attached at opposite ends to a control panel trim wrapper which underlies the faceplate and forms the exterior top and lateral sides of the control panel. After the mounting plate, including the control instruments mounted thereto, is attached to the panel trim wrapper, the control panel faceplate is placed over the mounting plate such that the stems or shafts provided by the control instruments extend through the faceplate openings.

The aforementioned prior art control panel assemblies suffers from several deficiencies or shortcomings which limit or reduce its desirability. For example, the prior art control panel assembly is dependent upon the faceplate and instrument mounting plate being exactly manufactured. Otherwise, the control instrument shafts will not perfectly align with the center of the holes in the faceplate. Since there is no direct physical relationship or connection between the mounting plate and the control panel faceplate, and due to machining tolerances and imperfections, the shafts have a tendency to not align with the center of the faceplate apertures, resulting in a nonuniform and sloppy appearance. Moreover, with an assembly of the aforementioned type, the control appliances or devices are only accessible via the rear of the appliance, increasing the time and labor required to repair or replace the control instruments.

Therefore, there exists a need in the art for an improved control panel assembly which positively indexes or locates the control instruments relative to the control panel faceplate such that alignment between the control instruments and the apertures in the faceplate is assured. Moreover, there exists a need in the art for an assembly of the aforementioned type wherein the control instruments are accessible from a front of the appliance.

SUMMARY OF THE INVENTION

The present invention provides an appliance control panel wherein the control instruments are indexed relative to the control panel faceplate to properly align with apertures provided thereby. The present invention also provides a control panel assembly wherein the control instruments housed therein are accessible for replacement or repair from a front of the control panel or appliance.

In accordance with the present invention the control panel includes a frame or support member, a faceplate, a mounting bracket, and mounting bracket retainer means. The frame member underlies and supports the faceplate. The mounting bracket is removably attached to a rear or inner surface of the faceplate by the mounting bracket retainer means.

In further accordance with the present invention, the faceplate includes a generally planar main body, a pair of lengthwise-directed rails, locating means, and first mounting means. The main body defines a series of openings through which the control instruments extend or are visible. The first mounting means mount a portion of the faceplate to the frame member, while the locating means are operable to properly position the mounting bracket relative to the faceplate.

In accordance with the present invention, the mounting bracket provides a planar main section, a pair of lengthwise directed legs, and second mounting means. The pair of legs engage the main body of the faceplate and space the main section of the mounting bracket therefrom. The second mounting means mounts the bracket to the frame member.

In further accordance with the present invention, a control panel faceplate assembly is adapted to mount to the control panel frame by positioning the faceplate assembly such that a tab extending therefrom projects into a notched opening in the frame, pivoting the faceplate assembly to engage the tab with a rear or inner surface of the frame, and lengthwise sliding the faceplate assembly to engage a portion of the faceplate assembly with an assembly retention means provided by the frame. The faceplate assembly includes the control panel faceplate with the mounting bracket and mounting bracket retainer mounted thereon. The frame comprises a trim wrapper and deflector. The assembly retention means comprises a tang which outwardly extends from the deflector.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
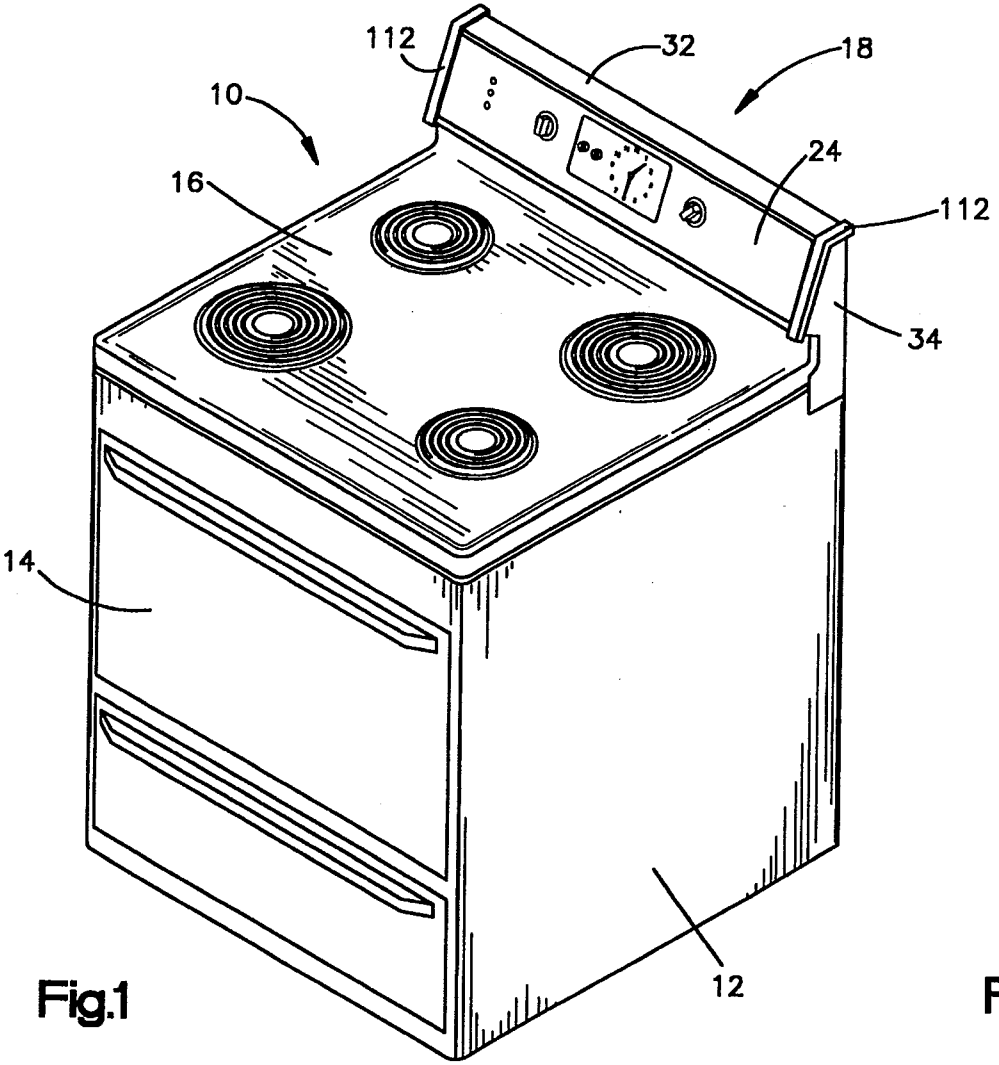
FIG. 1 is a perspective view of a domestic appliance incorporating the present invention.

With reference to FIG. 1, a domestic appliance incorporating the present invention is shown. The illustrated appliance 10, in this case a range, provides a generally box-like cabinet 12 having a front access opening which is closed by a pivotally mounted door 14. An upper surface 16 of the cabinet 12 provides a cook top having a series of burners or heating elements, as is conventional. The rear of the cabinet top has a control panel 18 projecting upwardly therefrom.

Figure 2:
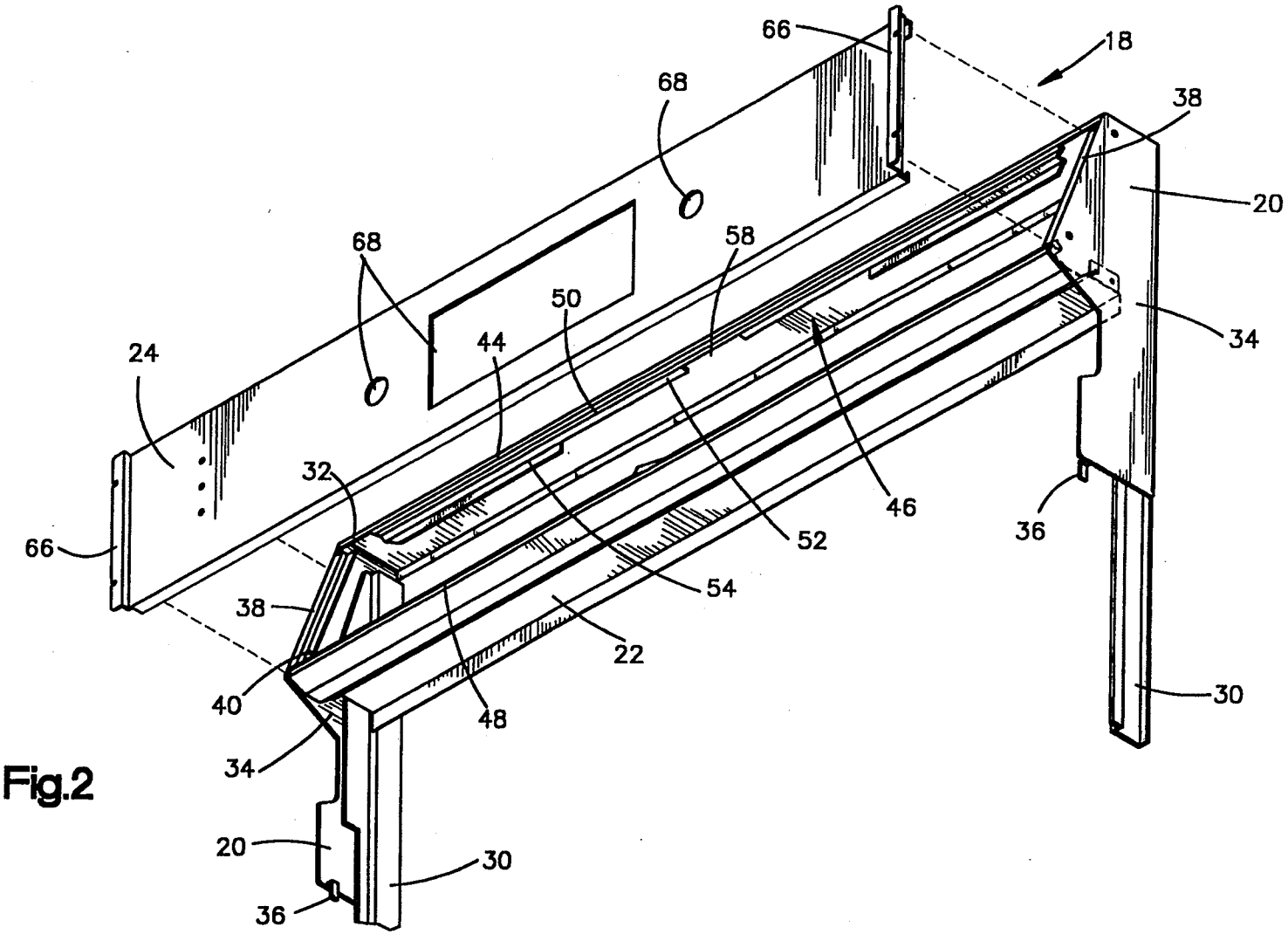
FIG. 2 is a partially exploded front perspective view, as viewed from below, of the control panel faceplate, trim wrapper, and deflector, in accordance with the present invention.
Figure 3:
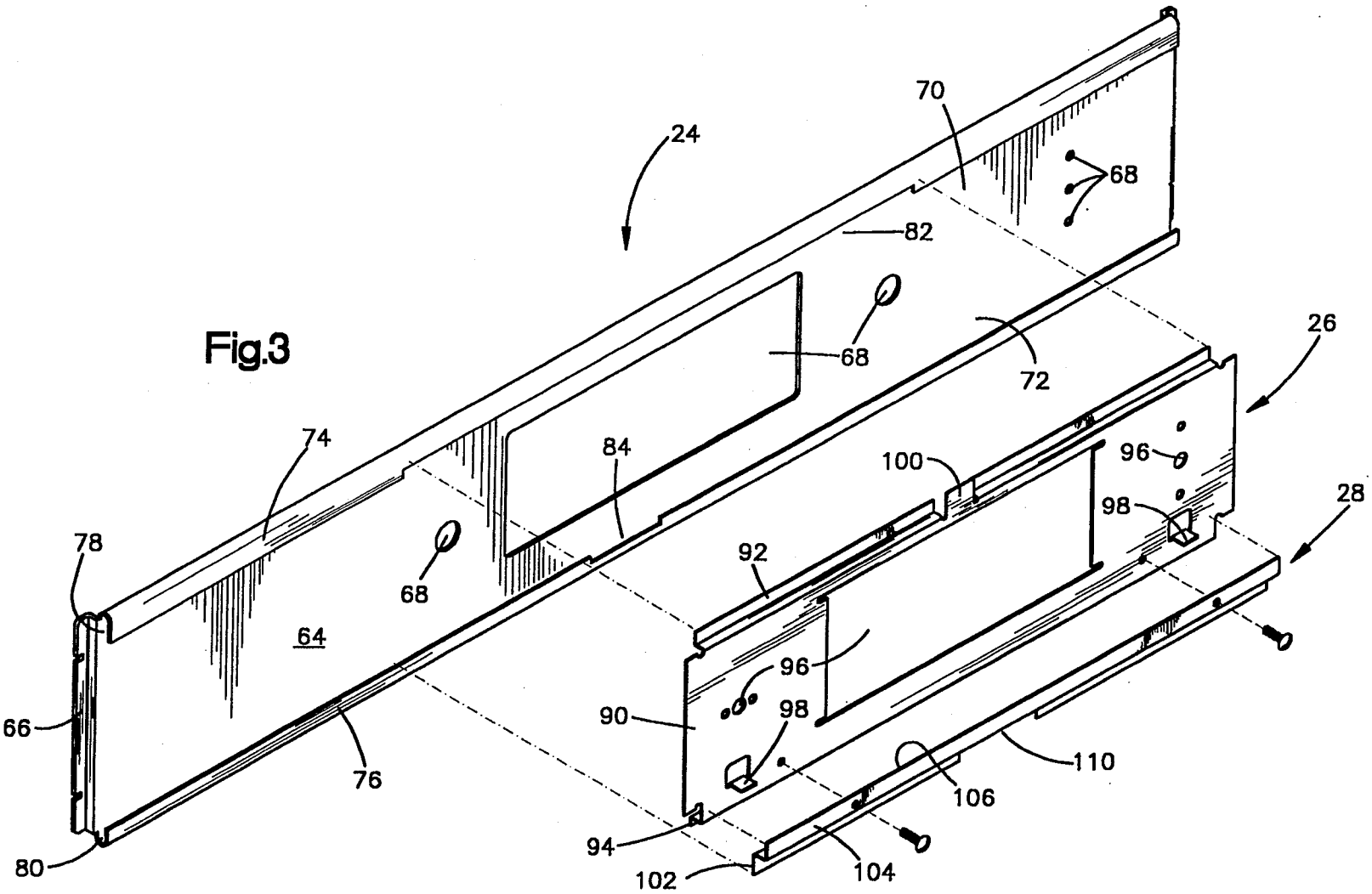
FIG. 3 is a rear exploded perspective view of the control panel faceplate, mounting bracket, and bracket retainer according to the present invention.
Figure 5:
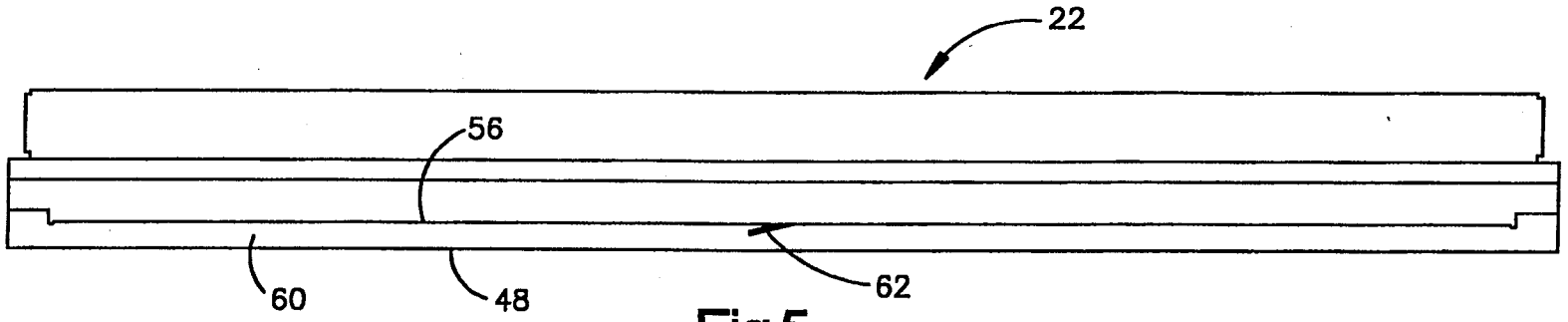
FIG. 5 is a top plan view of the trim deflector according to the present invention.
Figure 6:
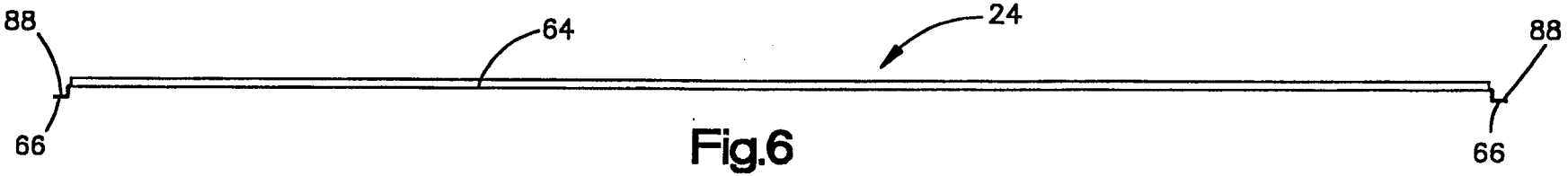
FIG. 6 is a top plan view of the control panel faceplate in accordance with the present invention.

As shown best in FIGS. 2 and 3, the control panel 18 includes a panel trim wrapper 20, a deflector 22, a control panel faceplate 24, a mounting bracket 26, and a mounting bracket retainer 28. The control panel faceplate 24 has an inner surface to which is mounted the mounting bracket 26 and mounting bracket retainer 28 and an outer surface which forms a portion of the visible front side of the control panel 18.

A pair of upright supports 30 interconnect the control panel 18 and the cabinet 12, or, more specifically, the trim wrapper 20 and the cabinet 12. In the illustrated control panel 18, the upright supports 30 space the control panel from the cook top provided by the upper surface 16 of the cabinet. Naturally, it is contemplated that various means may be employed to attach the control panel to the appliance cabinet. It is also recognized that in some appliances (i.e., clothes washing or drying machines) the control panel will not be spaced from the upper surface of the cabinet and, thus, the upright supports will be reduced in length or eliminated.

Figure 8:
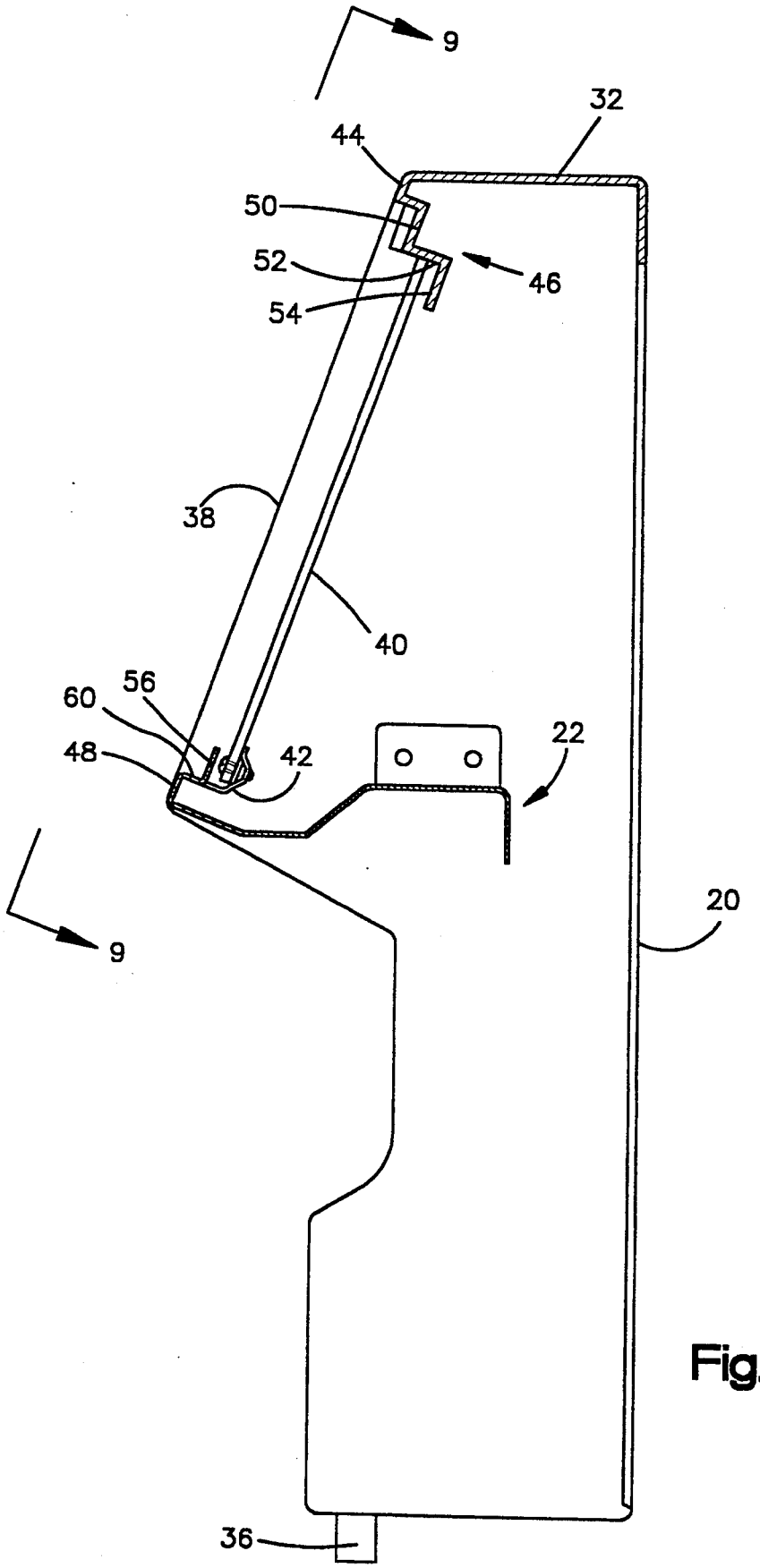
FIG. 8 is an end elevational view, partially in cross section, of the trim wrapper and deflector in accordance with the present invention.
Figure 9:
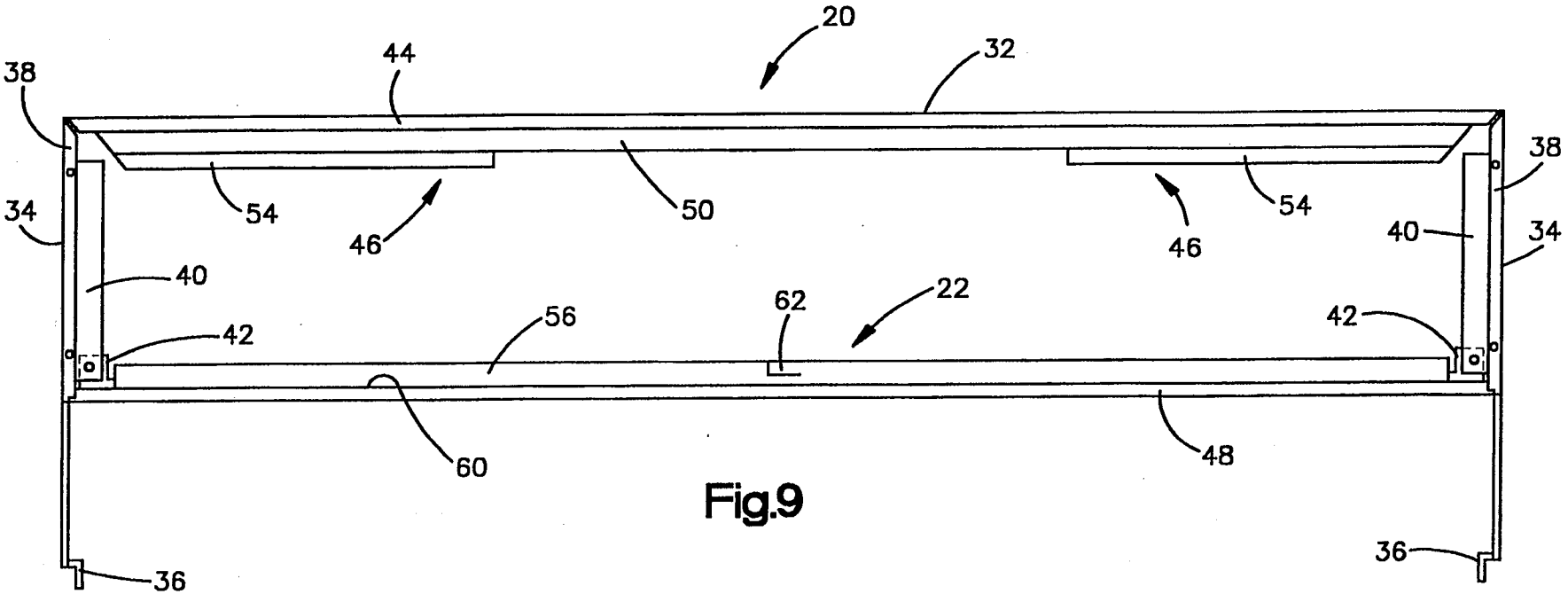
FIG. 9 is a front elevational view of the deflector and trim wrapper, as viewed from line 9—9 of FIG. 8.

As shown best in FIGS. 2, 8, and 9, the trim wrapper 20 provides an upper member 32 and a pair of opposed, vertically-oriented side members 34. The upper member 32 and side members 34 cooperate to define the top and lateral sides of the control panel 18, as illustrated. Preferably, the trim wrapper 20 is painted sheet metal which is bent or otherwise formed into the illustrated configuration.

A lower terminal end of each side member 34 includes inwardly and downwardly directed hooks 36. The hooks extend into slots (not shown) in the cabinet 12 and thereby locate or position the trim wrapper 20 and, hence, the control panel 18, relative to the upper surface 16 of the cabinet. Each of the side members 34 also include a mounting surface 38 and an inwardly projecting flange 40.

The mounting surfaces 38 provided by the side members 34 cooperate to support lateral sides of the control panel faceplate 24, as will be clear from the description to follow. Each of the mounting surfaces 38 also provide or define holes which facilitate the mechanical attachment of the control panel faceplate 24 thereto. The inwardly-projecting flanges 40 provided by the side members each attach to a like flange 42 provided by the deflector 22 to define and unify a frame or support member which underlies the control panel faceplate 24, as illustrated in FIG. 2.

With continued reference to FIGS. 2, 8, and 9, the upper member 32 of the trim wrapper 20 includes a front surface 44 and an inwardly and rearwardly-directed stepped flange 46. The front surface 44 cooperates with the outer surface of the control panel faceplate 24 and a like front surface 48 provided by the deflector 22 to define a forwardly-directed or front side of the control panel 18. Relatively inward from the front surface 44, the stepped flange 46 provides a support surface 50, a mounting surface 52, and a terminal surface 54. As will be discussed more fully hereafter, the support surface 50 cooperates with a like support surface 56 provided by the deflector 22 to support upper and lower portions of the control panel faceplate 24.

The mounting surface 52 provided by the stepped flange 46 defines a tab-receiving notch 58 (FIG. 2) to facilitate mounting and retention of the mounting bracket 26 and control panel faceplate 24 thereto. Preferably, the notch 58 is slightly offset from the center of the mounting surface 52 to facilitate receipt of a tab thereby, as will be described hereafter. The terminal surface 54 has a middle section thereof cut away to allow a tab to be inserted into the tab-receiving notch 58 of the mounting surface 52. The deflector 22 is attached between and interconnects the upright supports 30 and the trim wrapper side members 34. Hence, the deflector 22 and panel trim wrapper 20 cooperate to define a box-like frame or support member for the control panel 18 which provides a stable base for mounting of the control panel faceplate 24 and associated control instruments thereto.

As discussed previously, the front surface 48 of the deflector 22 defines a portion of the forward or front side of the control panel 18. A generally L-shaped flange extends inwardly or rearwardly from the front surface 48. The L-shaped flange includes the support surface 56, which is generally co-planar with the support surface 50 provided by the trim wrapper upper member 32, and an inwardly extending portion 60, which is perpendicular to the front surface 48.

As shown best in FIGS. 2 and 9, the deflector support surface 56 is cut or separated at a location generally midway along its length to provide a tang 62 which is outwardly bent therefrom. The tang 62 is engaged by and removably retains a portion of the control panel faceplate 24. As will be described more fully hereafter, the support surfaces 50, 56, tab-receiving notch 58, and tang 62 cooperate to removably mount the control panel faceplate 24 to the panel trim wrapper 20 and deflector 22.

Figure 7:
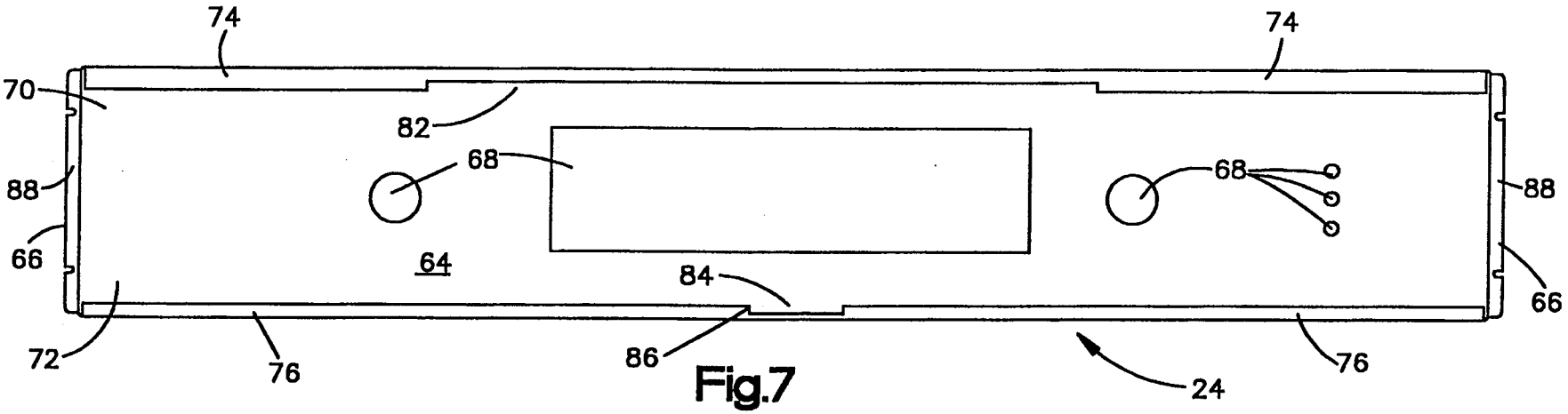
FIG. 7 is a rear elevational view of the control panel faceplate in accordance with the present invention.

The control panel faceplate 24 defines a generally planar main body 64 and a pair of lateral mounting ears 66. As shown best in FIGS. 3 and 7, the main body 64 provides a series of openings 68 through which the control instruments extend or are visible. Upper and lower portions 70, 72 of the main body 64 are bent or rounded over to form upper and lower lengthwise-extending support rails 74, 76. The upper and lower support rails 74, 76 define upper and lower longitudinal channels 78, 80, respectively. Preferably, and as illustrated, the upper channel 78 is relatively deeper than the lower channel 80.

The upper support rail 74 provides a notched recess 82 into which is fit the mounting bracket 26. The notched recess 82 serves as a locating or positioning means to ensure that the mounting bracket 26 is properly positioned with respect to the control panel faceplate 24. The lower support rail 76 provides a notched recess 84, one side or edge 86 of which is adapted to engage the tang 62 provided by the deflector 22 to mount the lower portion 72 of the main body 64 of the control panel faceplate 24 thereto.

Each of the lateral mounting ears 66 provide an attachment surface 88 which is parallel to but outwardly-spaced from the faceplate main body 64. The attachment surface 88 includes a pair of generally U-shaped openings which are adapted to receive or surround a conventional mechanical fastener such as a screw, bolt, or the like. The fasteners removably attach the attachment surfaces 88 to the mounting surfaces 38 provided by the side members 34.

When the attachment and mounting surfaces 88, 38 are in engagement, the upper and lower support rails 74, 76 of the control panel faceplate 24 engage the support surfaces 50, 56 provided by the trim wrapper upper member 32 and the deflector 22, respectively. The front surfaces 44, 48 of the upper member 32 and deflector 22 are generally co-planar and cooperate with the outer surface of the control panel faceplate 24 to define the front side of the control panel 18.

Figure 4:
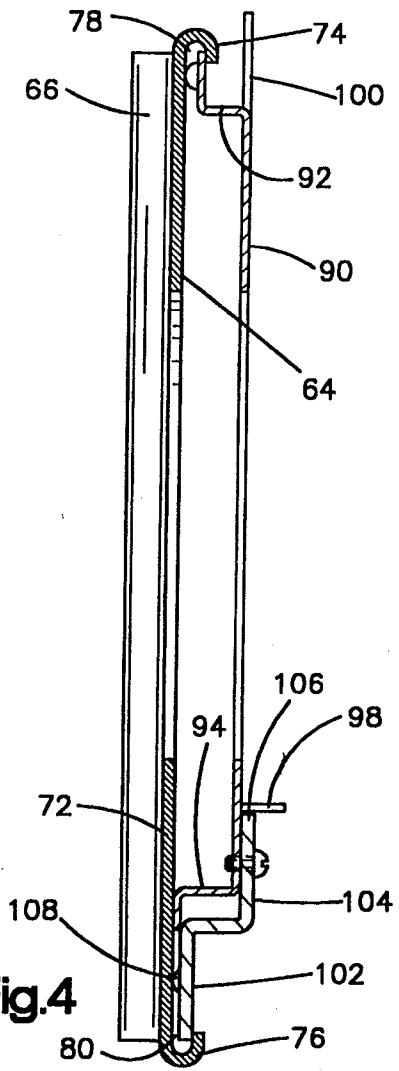
FIG. 4 is an elevational view, in cross section, of the assembled control panel faceplate, mounting bracket, and bracket retainer in accordance with the present invention.

The mounting bracket 26 has a generally planar main section 90 and upper and lower lengthwise-directed supporting legs 92, 94. The supporting legs 92, 94, which are generally L-shaped in cross section, maintain the main section 90 of the mounting bracket 26 a short distance from the faceplate main body 64, as shown best in FIG. 4.

The main section 90 includes a series of mounting holes 96 adapted to receive the control instruments, a pair of rearwardly or inwardly-directed positioning tabs 98, and an upwardly-directed locking tab 100. The positioning tabs 98, which are located near the lower supporting leg 94, are provided to properly position the mounting bracket retainer 28 during assembly. The locking tab 100 is provided to extend into the notch 58 provided by the mounting surface 52 of the trim wrapper upper member 32.

The mounting bracket retainer 28 is generally Z-shaped in cross section, having a lower leg 102 which is adapted to extend into the lower channel 80 provided by the control panel faceplate 24 and an upper leg 104 which is positioned over the mounting bracket 26, and is in engagement with the main section 90 thereof. A terminal edge 106 of the upper leg 104 is adjacent the positioning tabs 98 provided by the mounting bracket.

Figure 10:
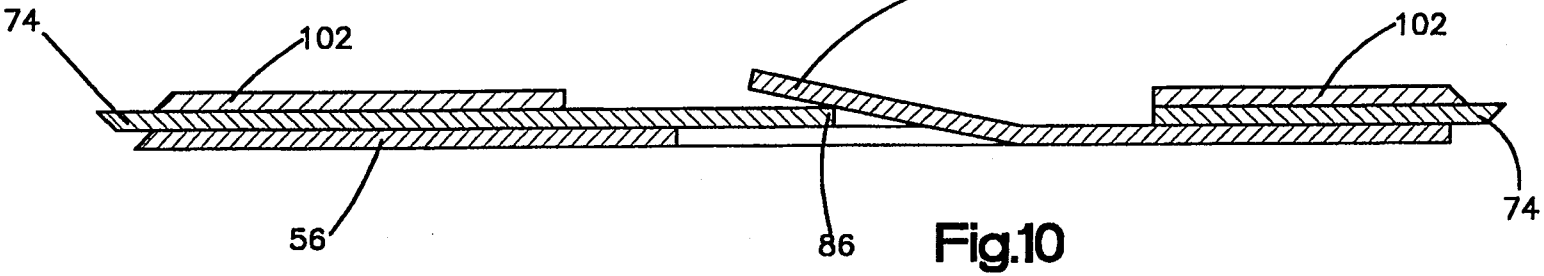
FIG. 10 is an enlarged cross sectional view of the engagement of the control panel faceplate and a tang provided by the deflector.

The lower leg 102 includes a pair of raised bosses 108 and a notch 110. The bosses 108 are provided to more snugly fit the lower leg 102 into the lower channel 80. The lower leg notch 110 is aligned with the notched recess 84 in the lower rail 76 and allows the edge 86 of the rail 76 surrounding the notched recess 84 to receive the tang 62 (FIG. 10). Conventional fasteners attach the retainer 28 to the mounting bracket 26.

Prior to mounting of the control panel faceplate 24 to the frame defined by the panel trim wrapper 20 and deflector 22, the mounting bracket 26, with various control instruments thereon, is attached to the control panel faceplate 24. While the lower supporting leg 94 is spaced from the main body 64 of the faceplate, the upper supporting leg 92 is slid into the upper channel 78 and a portion of the main section 90 adjacent the upper leg 92 is fit into the notched recess 82 in the upper support rail 74.

The upper support rail notched recess 82 is sized to receive the mounting bracket 26 and locates or indexes the mounting bracket relative to the faceplate 24 and, more specifically, the control instruments relative to the openings 68 in the main body 64 of the faceplate. The mounting bracket 26 is thereafter pivoted to allow the shafts or stems of the control instruments to extend through the openings 68 in the faceplate 24 and to bring the lower supporting leg 94 into engagement with the faceplate main body 64.

With the mounting bracket 26 so positioned on the control panel faceplate 24, the lower leg 102 of the mounting bracket retainer 28 is slid into the lower channel 80 defined by the lower support rail 76. The upper leg 104 of the retainer is placed over the mounting bracket, in engagement with the main section 90 thereof, and adjacent to or in engagement with the positioning tabs 98 provided thereby. The raised bosses 108 provided by the retainer 28 cause the lower leg 102 to engage the lower support rail 76 and thereby assist in maintaining the retainer within the lower channel 80.

The notch 110 in the lower leg of the mounting bracket retainer 28 is longer than the notched recess 84 in the lower support rail 76, and is located such that it overlaps or is coincident with the lower rail notched recess 84. As such, the notch 110 extends the length of the lower support rail notched recess 84 and beyond, allowing the tang 62 to engage the edge 86 of the lower support rail 76 surrounding the lower rail notched recess 84 when the faceplate 24 is attached to the frame defined by the trim wrapper 20 and deflector 22. Conventional fasteners attach the retainer 28 to the mounting bracket 26.

The faceplate 24, with the mounting bracket 26 and retainer 28 attached thereto, is removably attached to the trim wrapper 20 and deflector 22 by positioning the faceplate such that the locking tab 100 is received by the tab-receiving notch 58 in the mounting surface 52 of the trim wrapper upper member 32 and the lower support rail 76 is generally spaced from the deflector 22. The faceplate 24 is thereafter pivoted to bring the lower rail 76 into engagement with the support surface 56 of the deflector 22, and then slid lengthwise (i.e., to the right in FIGS. 1 and 2) to hook the tang 62 over the edge 86 of the lower support rail 74 surrounding the notched recess 84 (FIG. 10).

With the control panel faceplate so mounted, the attachment surfaces 88 of the lateral mounting ears 66 are in engagement with the mounting surfaces 38 of the side members 34 and the upper and lower support rails 74, 76 are in engagement with the upper member support surface 50 and the deflector support surface 56, respectively. The locking tab 100 retains the upper portion 70 of the faceplate main body 64 and the tang 62 retains the lower portion 72 of the faceplate main body 64. Fasteners more securely attach the faceplate mounting ears 66 to the side members 34. Corner pieces 112 are mounted over forward corners of the control panel 18, and attached to the side members 34 of the panel trim wrapper 20 with conventional fasteners, to complete assembly thereof.

While the preferred embodiment of the present invention is shown and described herein, it is to be understood that the same is not so limited but shall cover and include any and all modifications thereof which fall within the purview of the invention. For example, it is contemplated that the fasteners used to attach the mounting ears 66 to the side members 34 could be eliminated, and the additional mechanical attachment of the faceplate with the frame or support member being exclusively provided by the corner pieces 112.

What is claimed is

1. A control panel for a domestic appliance, said control panel comprising a frame, a faceplate, a mounting bracket, and a mounting bracket retainer, said frame generally underlying and supporting the faceplate, said faceplate comprising a generally planar main body which defines a series of openings, upper and lower lengthwise-directed rails, means for locating the mounting bracket relative to the faceplate, and means for releasably mounting the faceplate to the frame, said mounting bracket comprising a generally planar main section, a pair of legs engaging the main body of the faceplate and spacing the main section of the mounting bracket from the main body of the faceplate and means for releasably securing the mounting bracket to the frame said mounting bracket retainer operatively attaching the mounting bracket to the faceplate, wherein the mounting bracket is adapted to mountingly receive control instruments which extend or are visible through the openings in the main body of the faceplate.

2. A control panel according to claim 1, wherein the upper and lower lengthwise-directed rails define upper and lower channels, one of said upper and lower channels being adapted to receive one of the legs provided by the mounting bracket.

3. A control panel according to claim 2, wherein the mounting bracket retainer comprises an upper leg which overlies and engages the main section of the mounting bracket and a lower leg which extends into one of the upper and lower channels.

4. A control panel according to claim 1, wherein the locating means comprises a notched recess in one of said upper and lower lengthwise-directed rails, said notched recess being sized and located to receive the mounting bracket and properly position control instruments carried thereby relative to the openings in the faceplate.

5. A control panel according to claim 4, wherein the mounting bracket further comprises means for indexing the mounting bracket retainer with respect to the mounting bracket.

6. A control panel according to claim 5, wherein the upper and lower lengthwise-directed rails define upper and lower channels, one of said upper and Lower channels being adapted to receive one of the legs provided by the mounting bracket and the other of said upper and lower channels being adapted to receive the mounting bracket retainer.

7. A control panel according to claim 6, wherein the mounting means is a portion of the faceplate which slidably interlocks with a portion of the frame.

8. A control panel according to claim 5, wherein the securing means comprises a locking tab which is received by a portion of the frame to secure the mounting bracket thereto.

9. A domestic appliance comprising a cabinet, said cabinet providing a control panel which is accessible for user inspection and adjustment of various control instruments provided thereby, said control panel comprising:

frame including attachment means;

a control panel faceplate comprising a generally planar main body, upper and lower lengthwise-directed rails, and means for removably mounting the faceplate to the frame, said main body defining a series of openings through which the control instruments project or are visible, said rails defining upper and lower channels and said faceplate mounting means cooperating with the attachment means to removably mount the control panel faceplate to the frame;

a mounting bracket comprising a main section, means for releasably securing the mounting bracket to the frame, and a pair of legs, said main section being adapted to mountingly receive the various control instruments, said legs engaging the main body and spacing the main section from the main body of the face plate, said mounting bracket securing means cooperating with the attachment means to releasably secure the mounting bracket to the frame;

a mounting bracket retainer having a first portion which is received by one of the upper and lower channels and a second portion which overlies the main section of the mounting bracket.

10. A domestic appliance according to claim 9, wherein the frame comprises a control panel trim wrapper and a deflector, said trim wrapper defining an exterior top and lateral sides of the control panel.

11. A domestic appliance according to claim 10, wherein the attachment means comprises a notch in the trim wrapper, said notch being adapted to receive the mounting bracket securing means.

12. A domestic appliance according to claim 11, wherein the mounting bracket securing means comprises a locking tab and the faceplate mounting means comprises a portion of one of the upper and lower lengthwise-directed rails.

13. A domestic appliance according to claim 10, wherein the attachment means comprises a tang in the deflector, said tang being adapted to receive the faceplate mounting means.

14. A domestic appliance according to claim 13, wherein the mounting bracket securing means comprises a locking tab and the faceplate mounting means comprises a portion of one of the upper and lower lengthwise-directed rails.

15. A domestic appliance according to claim 14, wherein one of the mounting bracket legs is received by one of the upper and lower channels.

16. A domestic appliance according to claim 15, wherein the control panel faceplate further comprises means for positioning the mounting bracket, said positioning means being operable to properly align control instruments carried by the mounting bracket with the openings in the control panel faceplate.

17. A domestic appliance according to claim 16, wherein the mounting bracket positioning means comprises a notched recess in one of the upper and lower lengthwise-directed rails, said notched recess having a length dimension which is generally equal to a length of the mounting bracket.

18. A domestic appliance according to claim 9, wherein one of the mounting bracket legs is received by one of the upper and lower channels.

19. A domestic appliance according to claim 18, wherein the control panel faceplate further comprises means for positioning the mounting bracket, said positioning means being operable to properly align control instruments carried by the mounting bracket with the openings in the control panel faceplate.

20. A domestic appliance according to claim 19, wherein the mounting bracket positioning means comprises a notched recess in one of the upper and lower lengthwise-directed rails, said notched recess having a length dimension which is generally equal to a length of the mounting bracket.

* * * * *

UNITED STATES PATENT AND TRADEMARK OFFICE

CERTIFICATE OF CORRECTION

PATENT NO. : 5,375,921

DATED : December 27, 1994

INVENTOR(S) : Timothy J. Tupa, et al.

It is certified that error appears in the above-identified patent and that said Letters Patent is hereby corrected as shown below:

Col. 7, line 16, after "faceplate" insert --,--.

Col. 7, line 18, after "frame" insert --,--.

Col. 7, line 44, "Lower" should be --lower--.

Col. 7, line 61, before "frame" insert --a--.

Col. 8, line 10, "face plate" should be --faceplate--.

Signed and Sealed this

Sixteenth Day of May, 1995

Bruce Lehman

*Attest:*

BRUCE LEHMAN

*Attesting Officer*

*Commissioner of Patents and Trademarks*